US005965977A

United States Patent [19]

Makishima

[11] Patent Number: 5,965,977

[45] Date of Patent: Oct. 12, 1999

[54] APPARATUS AND METHOD FOR LIGHT EMITTING AND COLD CATHODE USED THEREFOR

[75] Inventor: Hideo Makishima, Tokyo, Japan

[73] Assignee: NEC Corporation, Tokyo, Japan

[21] Appl. No.: 08/828,836

[22] Filed: Mar. 24, 1997

[30] Foreign Application Priority Data

Mar. 28, 1996 [JP] Japan ..... 8-073693

[51] Int. Cl.[6] ..... H01J 63/06; H01J 1/30

[52] U.S. Cl. ..... 313/495; 313/309; 313/336; 313/351; 313/422

[58] Field of Search ..... 313/309, 336, 313/351, 495, 496, 497, 422

[56] References Cited

U.S. PATENT DOCUMENTS

| | | | |
|---|---|---|---|
| 4,818,914 | 4/1989 | Brodie | 315/169 |
| 5,290,610 | 3/1994 | Kane et al. | 313/336 |
| 5,495,146 | 2/1996 | Saito et al. | 313/495 |

FOREIGN PATENT DOCUMENTS

| | | | |
|---|---|---|---|
| 53-121454 | 10/1978 | Japan | H01J 1/30 |
| 4-133241 | 5/1992 | Japan | H01J 1/30 |
| 4133241 | 5/1992 | Japan | H01J 1/30 |
| 4-286852 | 10/1992 | Japan | H01J 63/06 |
| 4-286853 | 10/1992 | Japan | H01J 63/06 |
| 4-286854 | 10/1992 | Japan | H01J 63/06 |
| 4-286855 | 10/1992 | Japan | H01J 63/06 |
| 4286855 | 10/1992 | Japan | H01J 63/06 |
| 5182613 | 7/1993 | Japan | H01J 31/12 |
| 5-205616 | 8/1993 | Japan | H01J 9/02 |
| 5-205617 | 8/1993 | Japan | H01J 9/02 |
| 8129951 | 5/1996 | Japan | H01J 1/30 |

OTHER PUBLICATIONS

"Thin–Film–Edge Emitter Vacuum Microelectronics Devices for Lamp/Backlight Applications" Akinwande et al IVMC'95; pp. 418–422; 1995.

"A Thin–Film Field–Emission Cathode"; C.A. Spindt Journal of Applied Physics, vol. 39, No. 7; pp. 3504–3505; Dec. 1968.

"Field–Emission Display Resolution" Kesling et al SID 93 Digest; pp. 599–602; Dec. 1993.

"Technological Breakthrough in Development of Field Emitter Display" Yokoo et al Proceedings of the First International Display Workshop; pp. 19–22; Dec. 1994.

*Primary Examiner*—Ashok Patel

*Attorney, Agent, or Firm*—Hayes, Soloway, Hennessey, Grossman & Hage PC

[57] ABSTRACT

There is provided a cold cathode including a substrate, a plurality of electron emitting electrodes formed on the substrate, a first insulating layer formed on the substrate and formed with a plurality of first cavities in which the electron emitting electrodes are disposed, a gate electrode formed on the first insulating layer and formed with a plurality of first openings which are in communication with the first cavities, a second insulating layer formed on the gate electrode and formed with a plurality of second cavities which are in communication with the first openings, and a focusing electrode formed on the second insulating layer and formed with a plurality of second openings which are in communication with the second cavities. At least one of central axes of the second openings and central axes of the first openings is eccentric with central axes of the electron emitting electrodes. Eccentricity between at least one of the central axes of the second openings and the central axes of the first openings, and the central axes of the electron emitting electrodes is oriented outwardly, and a degree of the eccentricity is set greater at a location more remote from a centrally located electron emitting electrode.

44 Claims, 9 Drawing Sheets

APPARATUS AND METHOD FOR LIGHT EMITTING AND COLD CATHODE USED THEREFOR

BACKGROUND OF THE INVENTION

1. Field of the Invention

The invention relates to a cold cathode having a micro-sized structure and formed by means of thin film making technique, a method of fabricating such a cold cathode, and a light emitting apparatus including such a cold cathode, in particular, a light emitting apparatus suitable for a back light device to be used for a liquid crystal display, and also for a large size display.

2. Description of the Related Art

There has been suggested a field emission cold cathode by C. A. Spindt, "A Thin-Film Field-Emission Cathode", Journal of Applied Physics, Vol. 39, No. 7, pp. 3504–3505, 1968. The suggested field emission cold cathode has a plurality of unitary cold cathodes arranged in an array, each unitary cold cathode comprising a conically shaped emitter, and a control electrode or a gate electrode disposed in the vicinity of the emitter and having functions of extracting a current from an emitter and controlling an amount of the thus generated current. FIG. 1A illustrates the suggested field emission cold cathode 108, and FIGS. 1B and 1C illustrate cross-sections of a unitary cold cathode 107 constituting the field emission cold cathode 108 together with other unitary cold cathodes.

The field emission cold cathode 108 includes a silicon substrate 101, a insulating layer 102 made of silicon dioxide and formed on the silicon substrate 101, and a control electrode 103 formed on the insulating layer 102. A part of the insulating layer 102 and the control electrode 103 is removed to thereby form a cavity 109, in which an emitter 104 having a sharpened tip end is formed on the silicon substrate 101. The emitter 104, the control electrode 103 and the cavity 109 cooperate with each other to thereby form a unitary cold cathode 107. A plurality of unitary cold cathodes 107 are arranged in an array to thereby form the field emission cold cathode 108 having a planar electron emission area.

The silicon substrate 101 and the emitter 104 are in electrical contact with each other. A voltage of about 50 V is applied across the emitter 104 and the control electrode or gate electrode 103. A thickness of the insulating layer 102 and a diameter of an opening 103*a* formed with the gate electrode 103 are both quite small. Specifically, the insulating layer 102 has a thickness of about 1 $\mu$m, and the opening 103*a* of the gate electrode 103 has a diameter of about 1 $\mu$m. In addition, a tip end of the emitter has a diameter of about 10 nm, and hence is quite sharpened. Thus, by applying a voltage of about 50 V across the emitter 104 and the gate electrode 103, an intensive electric field is applied to a tip end of the emitter 104. When the thus generated electric field has an intensity in the range of $2\times10^7$ V/cm to $5\times10^7$ V/cm, a mass of electrons are emitted through a tip end of the emitter 104. By arranging a plurality of the above mentioned unitary cold cathodes 107 on the silicon substrate 101 in an array, there can be formed a planar cathode which is capable of generating a large amount of current. In addition, an arrangement of the above mentioned unitary cold cathodes in high density by utilizing micro-size-processing technology makes it possible to increase a current density five to ten times greater or more in comparison with a prior hot cathode.

The above mentioned Spindt type cold cathode has merits that it provides a higher cold cathode current density than a hot cathode, and that velocity dispersion of emitted electrons is smaller than a hot cathode. In addition, the Spindt type cold cathode emits smaller current noise in comparison with a single field emission cold cathode, and can operate even with a small voltage, specifically a voltage in the range of about 10 V to tens of V. Furthermore, the Spindt type cold cathode can operate even in relatively poor vacuum, specifically, in the range of about $10^{-5}$ Pa or greater.

There has been suggested another cold cathode in order to control focusing of electron beams emitted through a tip end of the emitter 104 by W. D. Kesling et al., "P-42: Field-Emission Display Resolution", SID 93 DIGEST, pp. 599–602, 1993. The suggested cold cathode includes, as illustrated in FIG. 1C, a silicon substrate 101, a silicon dioxide insulating layer 102 formed on the silicon substrate 101, a gate electrode 103 formed on the insulating layer 102, a second insulating layer 105 formed on the gate electrode 103, and a focusing electrode 106 formed on the second insulating layer 105. The insulating layer 102 is formed with a cavity 109*a* in which an emitter electrode 104 is disposed, and the second insulating layer 105 is formed with a cavity 109*b*. The gate electrode 103 is formed with an opening 103*a*, and the focusing electrode 106 is formed with an opening 106*a*. The cavities 109*a* and 109*b* and the openings 103*a* and 106*a* are in communication with one another.

As illustrated in FIG. 2, there has been suggested still another cold cathode including a silicon substrate 101, an insulating layer 102 formed on the silicon substrate 101, a control electrode 105 formed on the insulating layer 102 around an emitter electrode 104 which is disposed within a cavity 109 formed with the insulating layer 102, and a ring-shaped focusing electrode 111 formed on the insulating layer 102 around the control electrode 105 (K. Yokoo et al., "Technological Breakthrough in Development of Field Emitter Display", Proceedings of the First International Display Workshops, pp. 19–22, 1994). The ring-shaped focusing electrode 111 controls trajectory of electrons emitted from the emitter 104.

There have been also suggested various apparatuses for emitting electrons from a cold cathode such as those mentioned above to a fluorescent material to thereby make the fluorescent material luminous for displaying various information. For instance, such apparatuses are a planar display apparatus or a simple light emitting apparatus. A planar display apparatus is used as an output device of a computer or a display screen of a television set. By combining a plurality of light emitting apparatuses with one another, the combined light emitting apparatuses can be used as a large display screen for displaying letters information and/or television signals. Since those planar display apparatus and light emitting apparatus do not need to have a heater for heating a cold cathode and can use fluorescent material having a relatively high light emitting efficiency, those apparatuses are characterized by a high operation efficiency. With development of an information-oriented society, a demand for a display apparatus which is one of information output machines is predicted to increase, and power consumption in a display apparatus is required to be reduced. A display apparatus using a cold cathode therein is in line with such requirement.

U.S. Pat. No. 4,818,914 issued to Brodie has suggested a light emitting apparatus using a field emission type cold cathode. As illustrated in FIG. 3, the suggested light emitting apparatus includes an evacuated envelope 10 having an annular wall 12 of insulating material which is closed at one end by a light-transmitting member 14 and at the other end by a substrate 16. A highly conductive doped silicon layer 20 is deposited on the substrate 16 upon which layer an array of individual cathodes 22 is formed. A unitary accelerator electrode 28 is formed on a dielectric film 24. A unitary anode electrode 30 is deposited on an inner surface of the light-transmitting member 24, and a phosphor layer 32 is deposited on the anode electrode 30. A power source 36 applies a voltage across the silicon layer 20 and the anode electrode 30 to thereby cause electrons 42 to emit from the cathodes 22.

Japanese Unexamined Patent Publication No. 4-286852 has suggested a light emitting apparatus including a field emission cold cathode as illustrated in FIG. 4. The illustrated light emitting apparatus includes an electron beam source 1, a fluorescent material layer 2, a transparent electrode 3, and a deflecting electrode 4. Japanese Unexamined Patent Publication No. 4-286853 has suggested another light emitting apparatus including a field emission cold cathode as illustrated in FIG. 5. The illustrated light emitting apparatus includes an electron beam source 1, a collector plate 2 formed centrally with an opening window 5, a fluorescent material layer 3 formed on the collector plate 2, and a transparent electrode 4. Japanese Unexamined Patent Publication No. 4-286854 has suggested still another light emitting apparatus including a field emission cold cathode as illustrated in FIG. 6. The illustrated light emitting apparatus includes an electron beam source 1, a reflection plate 2 formed centrally with an opening 5, a transparent electrode 4, and a fluorescent material layer 3 formed at a surface of the transparent electrode 4.

The above mentioned United States Patent and Japanese Unexamined Patent Publications have suggested a method of spreading electrons in a greater emission angle which electrons are emitted from an electron emitting source having a smaller electron emitting area than an area of a fluorescent layer.

For another instance, there has been suggested an application of a panel constituted of thin-film-edge field emission cold cathodes to a backlight of a liquid crystal display device by A. I. Akinwande et al., "Thin-Film-Edge Emitter Vacuum Microelectronics Devices for Lamp/Backlight Applications", IVMC 95, pp. 418–422, 1995.

Japanese Unexamined Patent Publication No. 53-121454 has suggested a cold cathode including a substrate, emitters formed on the substrate, a first insulating layer formed on the substrate and formed with cavities in which the emitters are disposed, a gate electrode formed on the first insulating layer and formed with openings above the emitters, a second insulating layer formed on the gate electrode and formed with cavities above the emitters, and a focusing electrode formed on the second insulating layer and formed with openings above the emitters. The openings of the focusing electrode may be offset so that the focusing electrode is disposed just above the emitters in order to prevent direct ion bombardment to summits of the emitters.

Japanese Unexamined Patent Publication No. 4-133241 has suggested a cold cathode including an emitter projecting above a gate electrode.

The light emitting apparatus suggested in U.S. Pat. No. 4,818,914, illustrated in FIG. 3, needs to have a cold cathode 18 having almost the same area as that of the phosphor layer 32 for emitting electrons therethrough, resulting in necessity of a large area cold cathode. In addition, since the evacuated envelope 10 is cylindrical in shape, the cold cathode 18 is also required to be cylindrical in shape. In general, when a cold cathode is to be fabricated, a plurality of unitary cold cathodes are simultaneously fabricated by means of a thin film fabrication apparatus, similarly to fabrication of a semiconductor device. Hence, a unitary cold cathode is required to be as small as possible in size and rectangular in shape for conforming to semiconductor device fabrication process and also for reducing fabrication costs. However, the cold cathode used in the light emitting apparatus illustrated in FIG. 3 does not meet such conditions.

The light emitting apparatuses illustrated in FIGS. 4 and 5 attempts to make electron beams emitted from the cold cathode 1 diverge to thereby make luminescent the fluorescent screen 2 having a larger area than that of the cold cathode 1. The illustrated light emitting apparatuses both have the electrode 4 for diverging electron beams, disposed in an evacuated enclosure, and are in operation by applying a voltage to the electrode 4.

In the light emitting apparatus illustrated in FIG. 6, a light backwardly reflected from the fluorescent material layer 3 is forwardly reflected by the reflection plate 2 disposed in an evacuated enclosure.

In all of the light emitting apparatuses illustrated in FIGS. 4 to 6, electron beams are enlarged or a light is reflected and enlarged both by means of an electrode or an optical device. Thus, those light emitting apparatuses have problems that they are complicated in structure, and they have to have a number of parts.

It is necessary to prepare an electron emission source having a large area in order to construct a large luminescent area like a backlight in a thin panel structure. In such a electron emission source, in order to prevent the entire electron emission source from stopping in operation because of discharge breakdown and/or shortcircuit of a part thereof, it is necessary to divide an electron emission area into a plurality of sections and provide a fuse with each sections for removing a section destroyed by discharge breakdown or a shortcircuited section. When such a section is removed, electrons are not emitted from a removed section of the electron emission area, resulting in nonuniformity in luminance in a luminescent screen.

SUMMARY OF THE INVENTION

It is an object of the present invention to provide a cold cathode which is simpler in structure than conventional ones, but can prevent an increase in the number of parts, and which can eliminate nonuniformity in luminance in a luminescent screen.

In one aspect, there is provided a cold cathode including (a) a substrate, (b) a plurality of electron emitting electrodes formed on the substrate, (c) a first insulating layer formed on the substrate and formed with a plurality of first cavities in which the electron emitting electrodes are disposed, (d) a gate electrode formed on the first insulating layer and formed with a plurality of first openings which are in communication with the first cavities, (e) a second insulating layer formed on the gate electrode and formed with a plurality of second cavities which are in communication with the first openings, and (f) a focusing electrode formed on the second insulating layer and formed with a plurality of second openings which are in communication with the second cavities. In the above mentioned cold cathode, at least one of central axes of the second openings and central axes of the first openings is eccentric with central axes of the electron emitting electrodes.

For instance, eccentricity between at least one of central axes of the second openings and central axes of the first openings, and central axes of the electron emitting electrodes may be set random with respect to its degree and orientation.

There is further provided a cold cathode including (a) a substrate, (b) a plurality of electron emitting electrodes formed on the substrate, (c) a first insulating layer formed on the substrate and formed with a plurality of first cavities in which the electron emitting electrodes are disposed, (d) a gate electrode formed on the first insulating layer and formed with a plurality of first openings which are in communication with the first cavities, (e) a second insulating layer formed on the gate electrode and formed with a plurality of second cavities which are in communication with the first openings, and (f) a focusing electrode formed on the second insulating layer and formed with a plurality of second openings which are in communication with the second cavities. At least one of central axes of the second openings and central axes of the first openings is eccentric with central axes of the electron emitting electrodes. Eccentricity between at least one of central axes of the second openings and central axes of the first openings, and central axes of the electron emitting electrodes is oriented outwardly, and a degree of the eccentricity is set greater at a location more remote from a centrally located electron emitting electrode.

A central axis of an electron emitting electrode disposed at the center of the plurality of electron emitting electrodes, a central axis of an associated second opening, and a central axis of an associated first opening may be in alignment with one another.

The electron emitting electrodes may have a height above the first openings. It is preferable that a voltage equal to or higher than a voltage to be applied to the gate electrode is applied to the focusing electrode.

The above mentioned cold cathode may further include particles randomly formed on the electron emitting electrodes, the particles having a radius equal to or greater than a radius of curvature of a summit of the electron emitting electrodes. The radius of the particles may be in the range of 10 nm to 100 nm both inclusive.

The focusing electrode may be a ring in shape disposed around the gate electrode, in which case a voltage equal to or higher than a voltage of the gate electrode is applied to the focusing electrode.

In another aspect, there is provided a light emitting apparatus including (a) an evacuated enclosure, (b) a film made of fluorescent material and disposed within the evacuated enclosure, (c) an anode formed adjacent to the fluorescent material film, to which a voltage is to be applied for accelerating electron beams, (d) a cold cathode formed on a substrate within the evacuated enclosure in facing relation with the fluorescent material film, and (e) a device for causing electrons emitted from the cold cathode to have an increased velocity component in parallel with the substrate. Herein, the above mentioned device is, for instance, a voltage controller for applying a higher voltage to the anode than a voltage to be applied to the cold cathode.

The light emitting apparatus may further include a grid disposed closer to the fluorescent material film than the cold cathode between the fluorescent material film and the cold cathode. The grid extends over a length of the fluorescent material film, and a lower voltage than a voltage to be applied to the anode is to be applied to the grid. The grid may include opposite end portions projecting toward the fluorescent material film relative to other portions. The grid has a function of accelerating electron beams just before the fluorescent material film, and the opposite end portions of the grid have a function of inwardly directing electron beams directed to opposite ends of the fluorescent material film.

It is preferable that a voltage to be applied to the grid is equal to or smaller than a half of a voltage to be applied to the anode.

The grid may be formed in various shapes. For instance, the grid may be arcuate in shape.

The above mentioned cold cathodes including various preferred variants may be included in the light emitting apparatus.

The above mentioned cold cathode made in accordance with the present invention makes it possible to emit electron beams in a greater emission angle, and hence the cold cathode is allowed to have a smaller electron emission area than an area of the fluorescent material film. In addition, since it is also possible to dispose the cold cathode closer to the fluorescent material film, the light emitting apparatus including the cold cathode can be structured more simply.

When the above mentioned light emitting apparatus is to be used as a backlight apparatus, it is possible to provide a luminous screen having sufficient uniformity in luminance, even if there is nonuniformity in electron emission or if a part of the light emitting apparatus is not in operation for emitting electrons. In addition, since the cold cathode can be disposed closer to the fluorescent material film, it is possible to have a quite thin planar light source.

In still another aspect, there is provided a method of fabricating a cold cathode where at least one of central axes of openings formed with a focusing electrode and central axes of openings formed with a gate electrode is eccentric with central axes of electron emitting electrodes, including the steps of (a) forming a first insulating layer on a substrate, (b) forming a gate electrode layer on the first insulating layer, (c) forming a second insulating layer on the gate electrode layer, (d) forming a focusing electrode layer on the second insulating layer, (e) forming a first cavity both in the focusing electrode layer and second insulating layer, (f) covering the focusing electrode layer with and filling the first cavity with oxide, (g) forming a second cavity passing through the oxide filled in the first cavity, the gate electrode layer and the first insulating layer so that a central axis of the second cavity is not in alignment with a central axis of the first cavity, (h) forming an emitter in the second cavity, and (i) removing the oxide.

The step (h) may include the steps of (h-1) obliquely depositing a sacrifice layer in the second cavity while the substrate is being rotated, and (h-2) vertically depositing material of which the emitter is made in the second cavity.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 7:
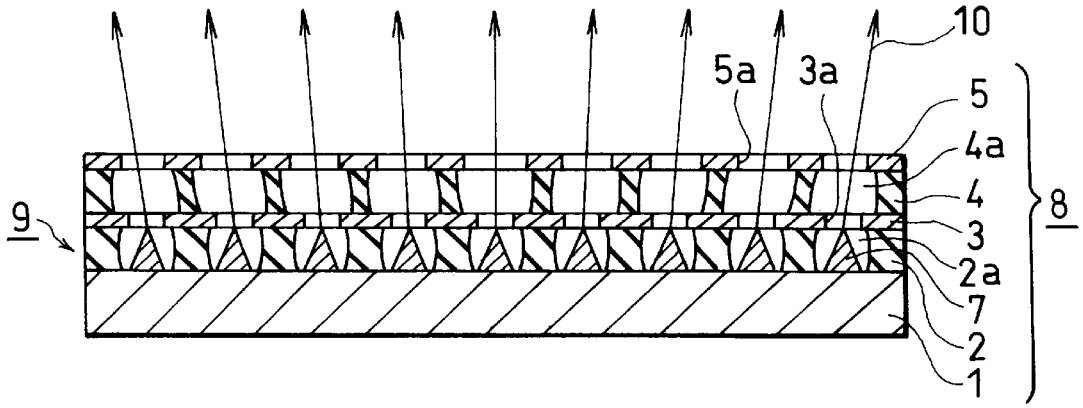
FIG. 7 is a cross-sectional view illustrating a cold cathode made in accordance with the first embodiment of the present invention.

FIG. 7 illustrates a cold cathode made in accordance with the first embodiment of the present invention. The illustrated cold cathode includes a substrate 1, a first insulating layer 2 formed on the substrate 1, a gate electrode 3 formed on the first insulating layer 2, a second insulating layer 4 formed on the gate electrode 3, and a focusing electrode 5 formed on the second insulating layer 4. The first insulating layer 2 is formed with a plurality of first cavities 2*a*, and similarly the second insulating layer 4 is formed with a plurality of second cavities 4*a*. The gate electrode 3 is formed with a plurality of first openings 3*a*, and similarly the focusing electrode 5 is formed with a plurality of second openings 5*a*. These cavities 2*a*, 4*a* and openings 3*a*, 5*a* are all in communication with one another. A conically shaped emitter 7 is formed on the substrate 1 within each of the cavities 4*a*. The emitter 7 is in electrical connection with the substrate 1, and emits electrons by applying a voltage thereto.

The emitter 7, the first insulating layer 2 formed with the first cavity 2*a*, the gate electrode 3 formed with the opening 3*a*, the second insulating layer 4 formed with the second cavity 4*a*, the focusing electrode 5 formed with the opening 5*a* cooperate with one another to thereby constitute a unitary cold cathode 8, and a group of unitary cold cathodes 8 constitute a cold cathode 9. A part of a surface of the cold cathode 9 where the unitary cold cathodes 8 are disposed constitute an electron emission area.

In the cold cathode 9 illustrated in FIG. 7, a central axis of the emitter 7 is in alignment with a central axis of the opening 3*a* of the gate electrode 3. However, a relation between those central axes of the emitter 7 and the opening 3*a* and a central axis of the opening 5*a* of the gate electrode 5 varies in dependence on where they are located in the electron emission area. Specifically, the central axes of the emitter 7, the gate electrode 3 and the focusing electrode 5 are in alignment with one another at the center of the electron emission area, but the central axis of the focusing electrode 5 is more outwardly away from the central axes of the emitter 7 and the opening 3*a* of the gate electrode 3 in a focusing electrode located more remote away from a focusing electrode located at the center of the electron emission area. In other words, eccentricity between the central axis of the focusing electrode 5 and the central axes of the emitter 7 and the opening 3*a* is oriented outwardly, and a degree of the eccentricity is set greater for an emitter located more remote from an emitter located at the center of the electron emission area.

As a result, electrons 10 emitted through summits of the emitters 7 have trajectory as illustrated in FIG. 7. Specifically, the electrons 10 emitted from the emitters 7 disposed at the center of the electron emission area are radiated straightly upwardly, and perpendicularly to the substrate 1, and the electrons 10 emitted from the emitters 7 disposed more remote the emitter 7 disposed at the center of the electron emission area are radiated more outwardly. It should be noted that emitters generally emit not only electrons directed in a direction along central axes of the emitters but also electrons directed in a direction making an angle with the central axes of the emitters, however, only electrons directed in a direction in which the greatest number of electrons are radiated among electrons directed in all directions are illustrated in the drawings with the reference numeral 10 for simplification.

The emitter 7 is made of refractory metal such as tungsten (W) and molybdenum (Mo), and silicon (Si). The gate electrode 3 is made of metal such as tungsten, molybdenum and niobium (Nb), or metal compound such as metal silicide. The first and second insulating layers 2 and 4 are formed of a single layer or multilayers composed of silicon dioxide or silicon nitride. The opening 3*a* formed with the gate electrode 3 has a diameter of about 1 $\mu$m, the emitter has a height of about 1 $\mu$m, the first insulating layer has a thickness of about 0.8 $\mu$m, and the gate electrode 3 has a thickness of about 0.2 $\mu$m.

Figure 1A:
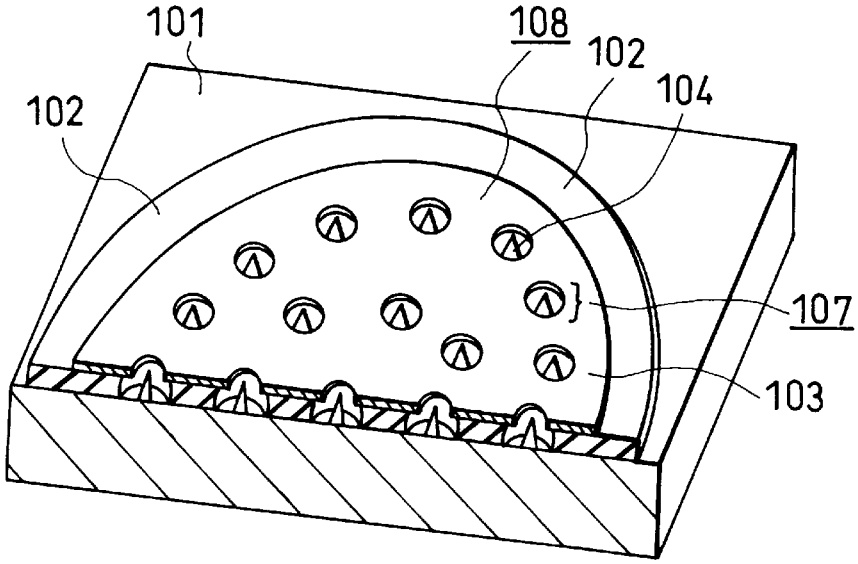
FIG.1A PRIOR ART
FIG. 1A is a perspective view illustrating a conventional Spindt type cold cathode.
Figure 1B:
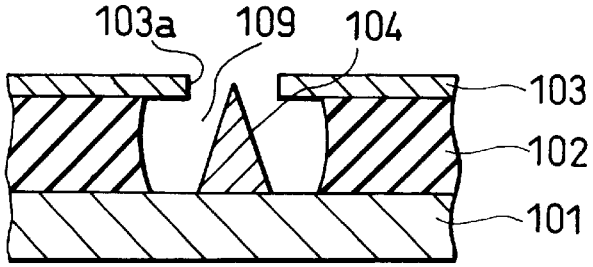
FIG.1B PRIOR ART
FIG. 1B is a cross-sectional view of a unitary cold cathode of the Spindt type cold cathode illustrated in FIG. 1A.
Figure 1C:
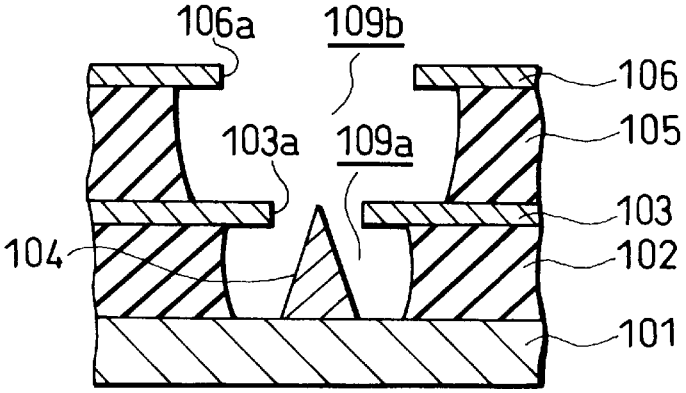
FIG.1C PRIOR ART
FIG. 1C is a cross-sectional view of another conventional unitary cold cathode.
Figure 2:
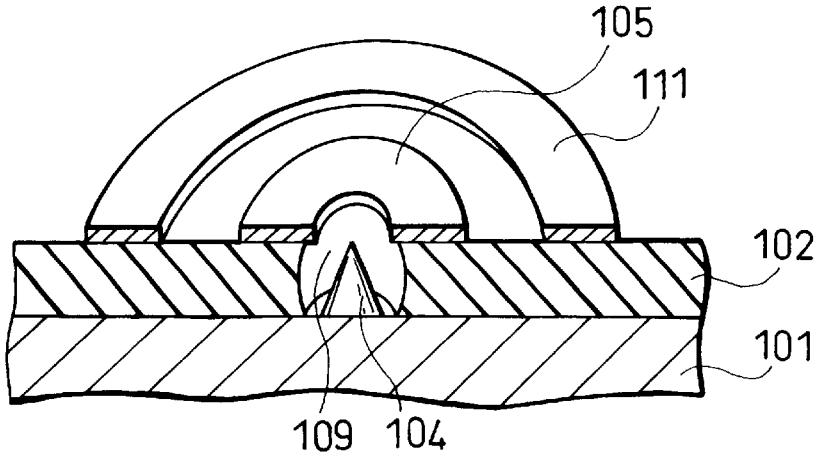
FIG. 2 PRIOR ART
FIG. 2 is a perspective view illustrating still another conventional unitary cold cathode provided with a focusing electrode.
Figure 3:
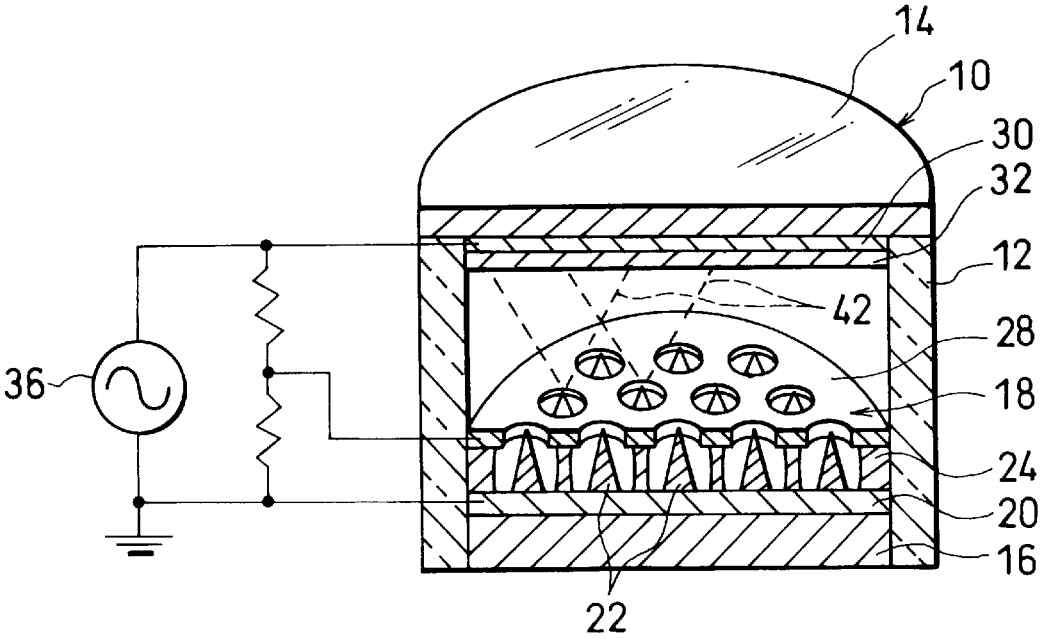
FIG. 3 PRIOR ART
FIG. 3 is a cross-sectional view illustrating a conventional light emitting apparatus.
Figure 4:
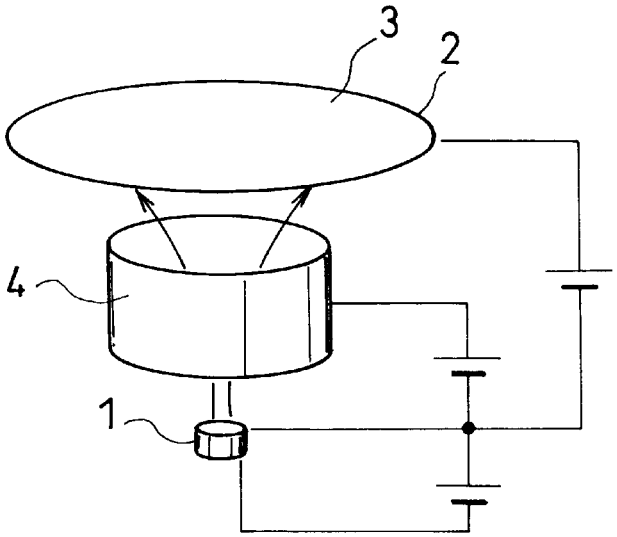
FIG. 4 PRIOR ART
FIG. 4 is a perspective view illustrating another conventional light emitting apparatus.
Figure 5:
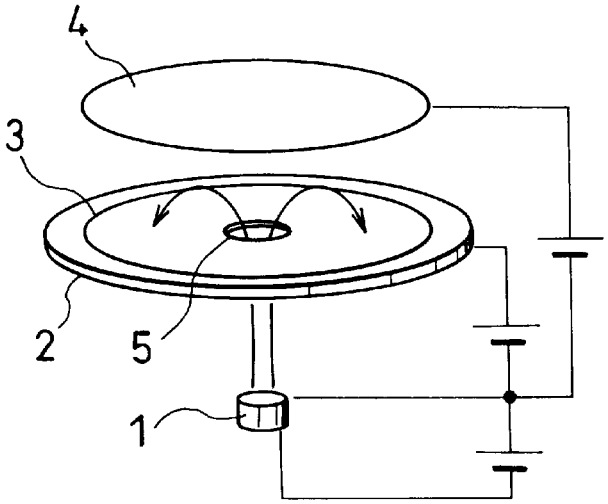
FIG. 5 PRIOR ART
FIG. 5 is a perspective view illustrating still another conventional light emitting apparatus.
Figure 6:
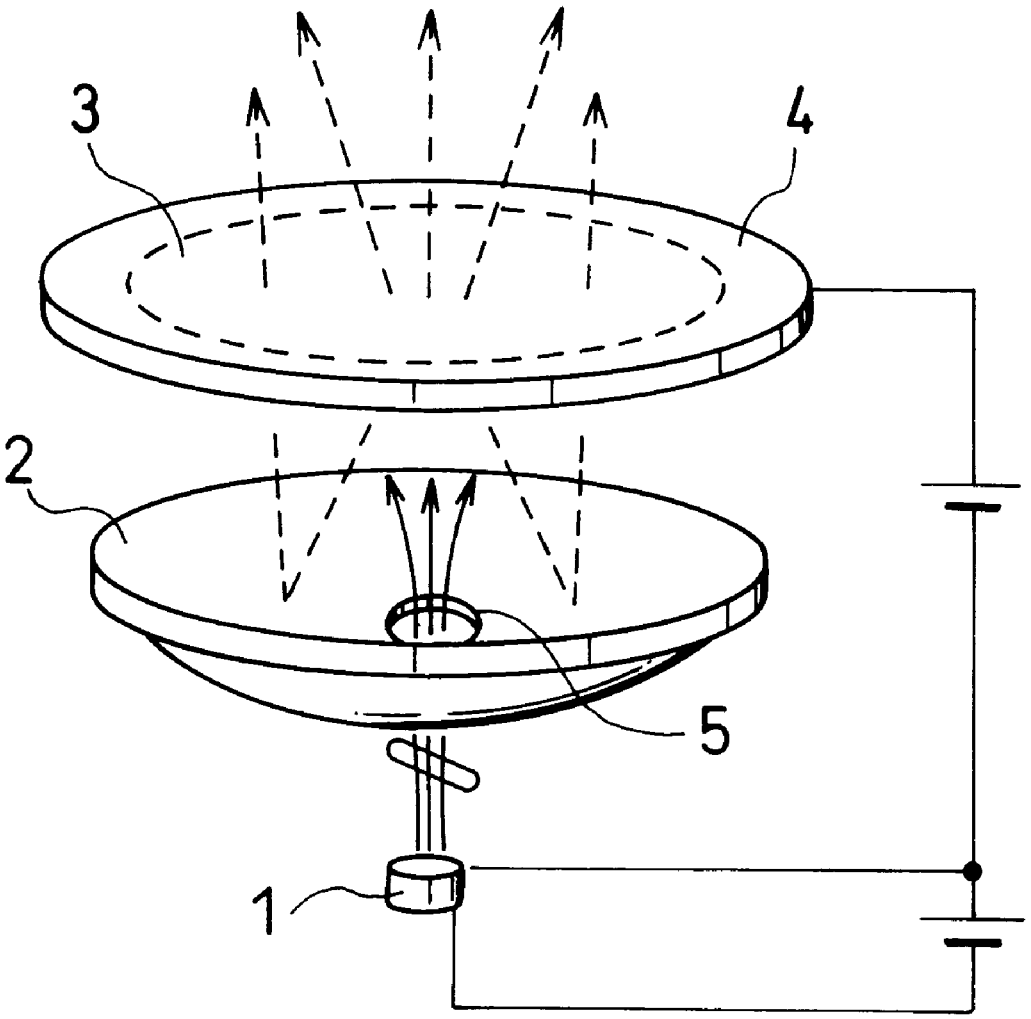
FIG. 6 PRIOR ART
FIG. 6 is a perspective view illustrating yet another conventional light emitting apparatus.

The cold cathode 9 illustrated in FIG. 7 may have such a focusing electrode as illustrated in FIG. 2, which is formed surrounding a gate electrode. By providing eccentricity to the central axes of the emitter and openings of the gate electrode and focusing electrode, it is possible to have electron beams spreading from the center toward periphery of the electron emission area.

Figure 8:
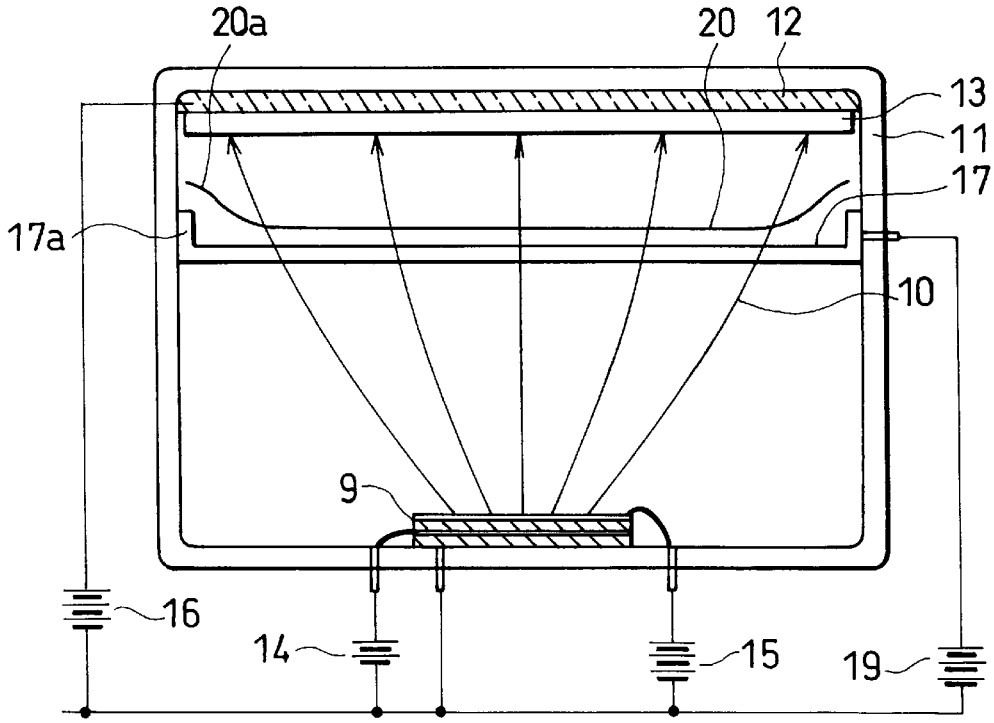
FIG. 8 is a cross-sectional view illustrating a light emitting apparatus made in accordance with the second embodiment of the present invention.

FIG. 8 illustrates a light emitting apparatus made in accordance with the second embodiment of the present invention. The illustrated light emitting apparatus includes an evacuated enclosure 11 made of glass in which the cold cathode 9 illustrated in FIG. 7 is placed on a bottom surface. A transparent anode 12 made of nesa-film or ITO film is formed on an inner surface of a top surface of the glass enclosure 11, and a luminous layer 13 made of fluorescent material is formed on the transparent anode 12. The electron emission area of the cold cathode 9 is in facing relation to the transparent anode 12 and the luminous layer 13.

A gate electrode power supply 14 applies a voltage of about 50 V to the gate electrode 3, and a focusing electrode power supply 15 applies a voltage of about 100 V to the focusing electrode 5. An anode power supply 16 applies a dc voltage in the range of about 1 kV to 10 kV to the transparent anode 12. Herein, the above mentioned voltages of 50 V, 100 V and 1 kV to 10 kV are voltages on the assumption that a voltage of the cold cathode 9 and the substrate 1 is equal to zero.

The light emitting apparatus also includes a grid 17 disposed closer to the transparent anode 12 than the cold cathode 9 between the transparent anode 12 and the cold cathode 9. The grid 17 has a length covering an entire length of the transparent anode 12 or the luminous film 13, and has opposite end portions 17*a* projecting toward the luminous film 13 relative to other portions of the grid 17. A voltage lower than a voltage to be applied to the transparent anode 12 is applied to the grid 17 by a grid power supply 19. In this embodiment, the grid power supply 19 applies a voltage to the grid 17 which voltage is equal to or smaller than a half of a voltage to be applied to the transparent anode 12.

When the above mentioned voltages are applied, there are formed an equipotential plane 20 in parallel with the grid 17 between the grid 17 and the cold cathode 9 in the glass enclosure 11. As a result, the electron beams 10 emitted from the cold cathode 9 are accelerated toward the grid 17 and at the same time, are made to diverge horizontally. In particular, since the electrons emitted from the cold cathode 9 have an increased velocity component in parallel with the substrate 1 on which the cold cathode 9 is formed, the electron beams 10 are made diverge horizontally in a great angle. The electron beams 10 passing through the grid 17 are further accelerated by an intensive electric field generated between the grid 17 and the transparent anode 12, and bombard the fluorescent material layer 13 to thereby make the fluorescent material layer 13 luminous. Thus, the electron beams 10 are radiated onto the fluorescent material layer 13 having a larger area than an area of the electron emission area of the cold cathode 9 to thereby make it possible to make the fluorescent material layer 13 luminous.

The grid 17 establishes an electric field having an intensity not depending on a voltage of the transparent anode 12, but depending only on a difference in voltage between the grid 17 and the cold cathode 19. Thus, by setting a voltage of the grid 17 to be sufficiently lower than a voltage of the transparent anode 12, it is possible to make the electron beams 10 diverge horizontally in a greater angle between the grid 17 and the cold cathode 9, resulting in that the fluorescent material layer 13 having a larger area than an area of the electron emission area can be made luminous in comparison with a light emitting apparatus having no grid 17.

The opposite end portions 17*a* of the grid 17 further establishes equipotential planes 20*a* in a space between the grid 17 and the transparent 12. As illustrated in FIG. 8, the equipotential planes 20*a* are continuous with the equipotential plane 20 and are located at opposite ends of the equipotential plane 20. The equipotential planes 20*a* make the electron beams 10 directing to opposite ends of the fluorescent material film 13 slightly inwardly deflect to thereby cause an angle at which the electron beams 10 bombards the fluorescent material film 13 to be almost 90 degrees, resulting in that reflection of the electron beams 10 and discharge of secondary electrons are prevented to thereby make energy of the electron beams 10 contribute to light-emission of the fluorescent material film 13. In order to vary a degree of light-emission of the fluorescent material film 13, a signal voltage varying up and down with a voltage of about 50 V as a central voltage may be applied to the gate electrode 3 in place of a dc voltage.

Similarly to the above mentioned embodiment, Japanese Unexamined Patent Publication No. 4-286855 has suggested a light emitting apparatus having a grid disposed between a cold cathode and a fluorescent material film. However, the suggested light emitting apparatus attempts to prevent positive ions generated between a grid and a fluorescent film making bombardment to a cold cathode, and hence is structurally characterized in that a grid is disposed in the vicinity of a cold cathode, that a voltage equal to or higher than a voltage to be applied to an anode is applied to a grid, and that a grid is formed hemispherical in shape so that the grid projects toward an anode. Thus, the light emitting apparatus disclosed in the Publication No. 4-286855 is essentially different from the light emitting apparatus made in accordance with the present invention.

Figure 9:
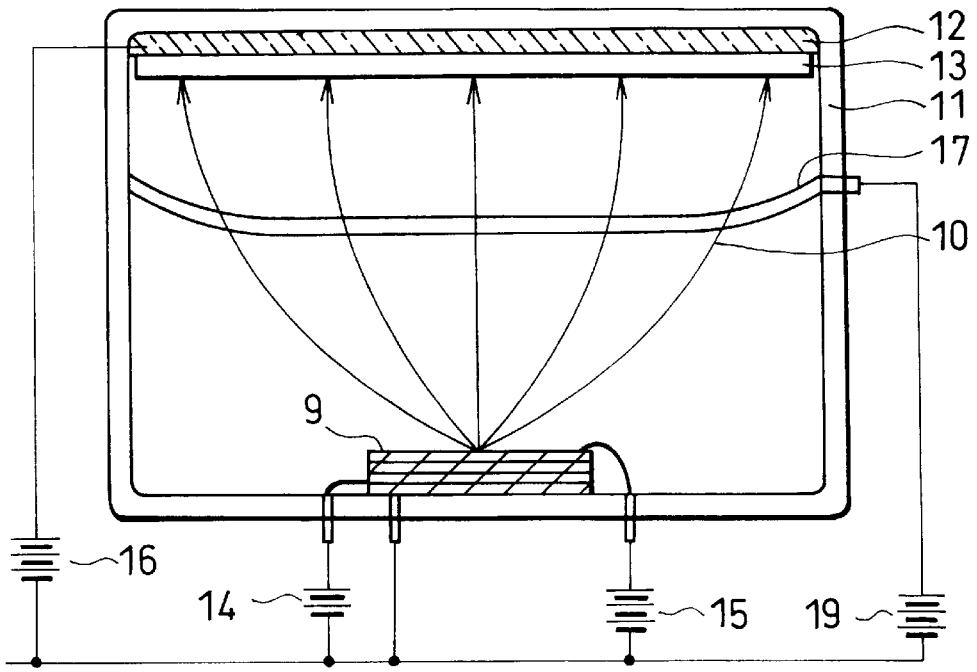
FIG. 9 is a cross-sectional view illustrating a light emitting apparatus made in accordance with the third embodiment of the present invention.

FIG. 9 illustrates a light emitting apparatus made in accordance with the third embodiment of the present invention. The third embodiment is different from the second embodiment in that the grid 17 is formed arcuate in shape projecting toward the cold cathode 9. The third embodiment provides the same advantages as those obtained by the second embodiment. It is possible in the third embodiment to minutely control the electron beams 10 in dependence on an arcuate shape of the grid 17. The additional formation of the opposite end portions 17*a* as illustrated in FIG. 8 provides much greater designability.

Figure 10:
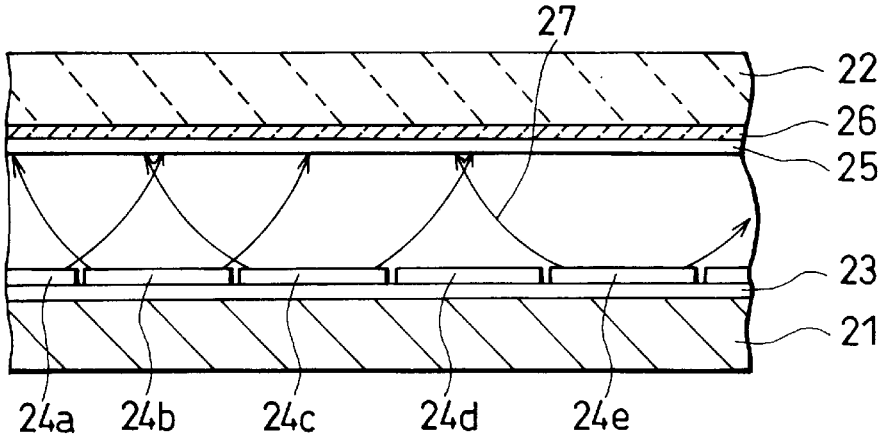
FIG. 10 is a cross-sectional view illustrating a backlight apparatus made in accordance with the fourth embodiment of the present invention.

FIG. 10 illustrates a backlight apparatus made in accordance with the fourth embodiment of the present invention. The illustrated backlight apparatus includes a back panel 21 and a front panel 22 which are secured to each other at marginal portions thereof to thereby constitute an evacuated envelope. A cathode electrode 23 is formed on the back panel 21, and a plurality of cold cathode segments 24*a*, 24*b*, 24*d*, 24*d* and 24*e* are formed on the cathode electrode 23. There is formed a fluorescent material film 25 on the front panel 22 with a transparent anode 26 sandwiched therebetween. Electron beams 27 emitted from the cold cathode segments 24*a* to 24*e* are accelerated by a dc voltage ranging from a few hundreds of volts to a few thousands of volts between the cathode electrode 23 and the transparent anode 26 to thereby bombard the fluorescent material film 25. For simplification, the reference numeral 27 indicates only trajectory of electrons emitted from opposite edge portions of the cold cathode segments 24*a* to 24*e*.

Figure 11:
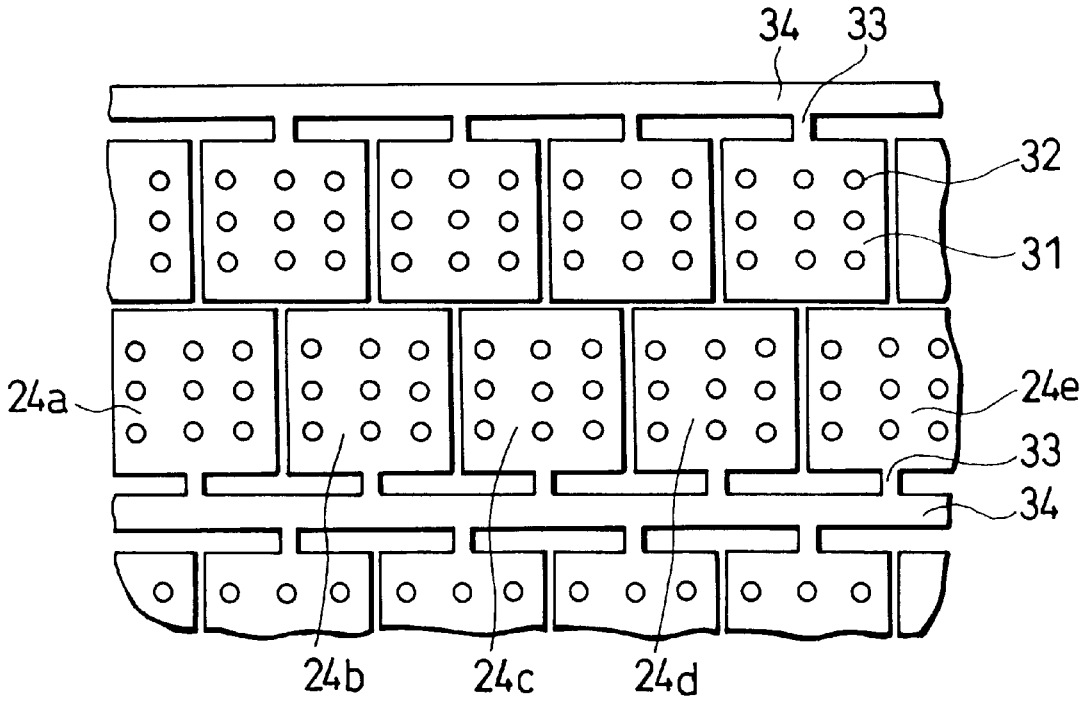
FIG. 11 is a plan view illustrating a cathode used for the backlight apparatus illustrated in FIG. 10.

FIG. 11 is a plan view of the cold cathode segments 24*a*, 24*b*, 24*c*, 24*d* and 24*e* of the backlight apparatus illustrated in FIG. 10. FIG. 11 illustrates only a part of the cold cathodes formed on the back panel 21. An entire cold cathode of the backlight apparatus is composed of repetition of a pattern as illustrated in FIG. 11. Each of the cold cathode segments 24*a* to 24*e* includes a gate electrode segment 31 formed with a plurality of openings 32 in which the emitter 7 is disposed. Each of the gate electrode segments 31 is in connection with a gate electrode wiring 34 through a fuse 33. When an emitter is shortcircuited with an associated gate electrode, the fuse 33 separates a unitary cold cathode including the shortcircuited emitter from an associated gate electrode wiring 34 to thereby prevent inoperability in other unitary cold cathodes. Though not illustrated in FIG. 11, there is formed a focusing electrode on the gate electrode with an insulating layer sandwiched therebetween. A voltage supplied from an external power supply (not illustrated) is supplied to the gate electrode through the gate electrode wiring 34.

In each of the cold cathode segments 24*a* to 24*e* in the backlight apparatus illustrated in FIG. 10, a unitary cold cathode disposed more remote away from a unitary cold cathode disposed at the center of a cold cathode segment has a greater space between a central axis of an opening formed at a focusing electrode and central axes of an opening formed at a gate electrode and an emitter, as illustrated in FIG. 7. Thus, the electron beams 27 emitted from the cold cathode segments 24*a* to 24*e* are horizontally diverged in a great angle, as illustrated in FIG. 10. As a result, even if the cold cathode segment 24*d* is not capable of emitting electron beams for some reasons, the electron beams 27 reach a part of the fluorescent material film 25 facing to the cold cathode segment 24*d,* thereby significant nonuniformity in luminance in the fluorescent material film 25 being prevented. Similarly, even if some unitary cold cathodes emit less electron beams than usual for some reasons, local nonuniformity in luminance in the fluorescent material film 25 is prevented.

In place of the cold cathode 9 illustrated in FIG. 7, there may be employed cold cathodes as illustrated in FIGS. 12 to 16, as detailed below.

Figure 12:
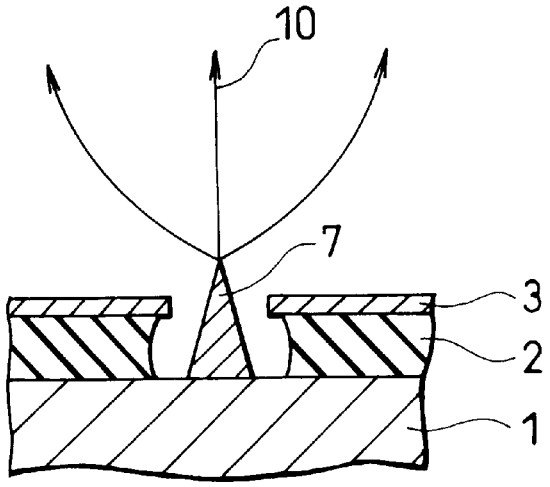
FIG. 12 is a cross-sectional view of a cold cathode substituted for the cold cathode illustrated in FIG. 7.

A unitary cold cathode illustrated in FIG. 12 includes the emitter 7 having a height above the gate electrode 3. In the illustrated unitary cold cathode, since equipotential planes between the emitter 7 and the gate electrode 3 is remarkable deformed by the emitter 7, the equipotential planes have a small radius of curvature in the vicinity of a summit of the emitter 7, and hence the electron beams 10 emitted from the emitter 7 have a wide distribution in divergent emission angle.

Figure 13:
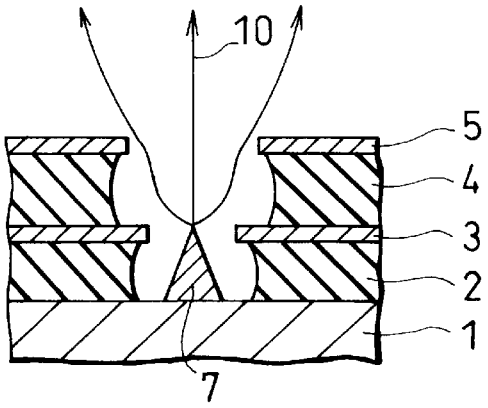
FIG. 13 is a cross-sectional view of a cold cathode substituted for the cold cathode illustrated in FIG. 7.

As illustrated in FIG. 13, it is possible to make the electron beams 10 diverge in a way opposite to usual divergence by applying a suitable voltage to the gate electrode 3. In usual, the gate electrode 3 receives a voltage about 50 V higher than a voltage of the emitter 7 and the focusing electrode 5 receives almost the same voltage as a voltage of the emitter 7 to thereby make the electron beams converge. In contrast, the electron beams 10 can be diverged in a way as illustrated in FIG. 13 by applying a voltage equal to or higher than a voltage to be applied to the gate electrode 3 to the focusing electrode 5.

Figure 14:
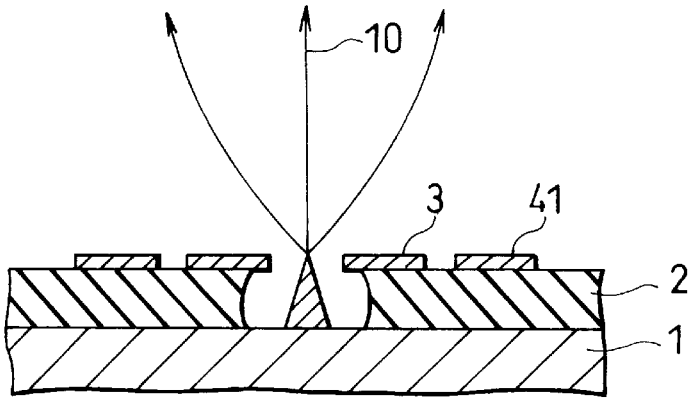
FIG. 14 is a cross-sectional view of a cold cathode substituted for the cold cathode illustrated in FIG. 7.

FIG. 14 illustrates a unitary cold cathode including a ring-shaped focusing electrode 41 disposed around the gate electrode 3. In usual, a voltage smaller than a voltage across the gate electrode 3 and the emitter 7 or a voltage smaller than a voltage of the emitter 7 is applied to the ring-shaped focusing to thereby make the electron beams converge in a unitary cold cathode as illustrated in FIG. 14. In contrast, it is possible to make the electron beams 10 diverge by applying a voltage equal to or higher than a voltage of the gate electrode 3 to the ring-shaped focusing electrode 41. As an alternative, the same advantageous effects as those provided by the unitary cold cathode illustrated in FIG. 14 can be obtained by applying a voltage equal to or higher than a voltage of the gate electrode to a ring-shaped or non-ring-shaped focusing electrode having a common opening for a plurality of emitters.

Figure 15:
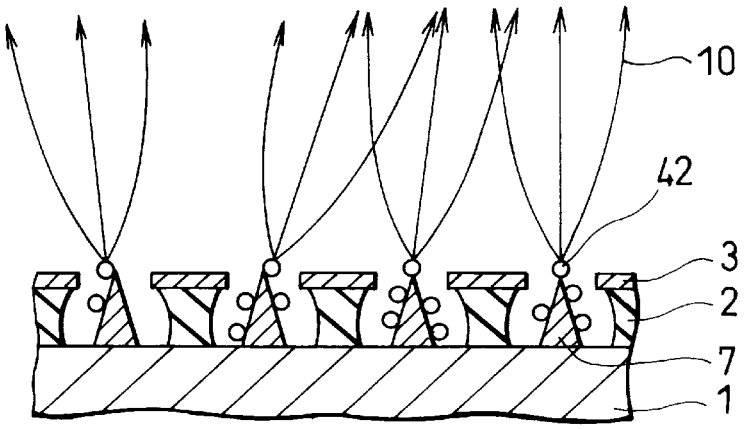
FIG. 15 is a cross-sectional view of a cold cathode substituted for the cold cathode illustrated in FIG. 7.

A cold cathode illustrated in FIG. 15 further includes particles 42 randomly stuck on a surface of the emitter 7. The particles 42 is designed to have a radius equal to or greater than a radius of curvature of a summit of the emitter 7. Specifically, the radius of curvature of the particles 42 is in the range of 10 nm to 100 nm both inclusive. In the illustrated cold cathode, electron beams are emitted not only through a summit of the emitter 7 but also through the particles 42. In addition, as the particles 42 are randomly stuck to a surface of the emitter 7, irregularity is added to electron beam emission directions, resulting in that there can be obtained the electron beams 10 made to diverge horizontally in a greater angle.

Japanese Unexamined Patent Publications Nos. 5-205616 and 5-205617 have suggested an emitter on a surface of which diamond-crystallite having fine particle structure is made grown for the purpose of reduction in an operation voltage, enhancement in resistance to ion bombardment, and enhancement in surface stability. However, according to the Publications, diamond-crystallite particles are stuck not randomly but uniformly onto a surface of an emitter, and in addition, there has not been disclosed or suggested a particle size which is large enough to exert influence on emission directions of electron beams.

Figure 16:
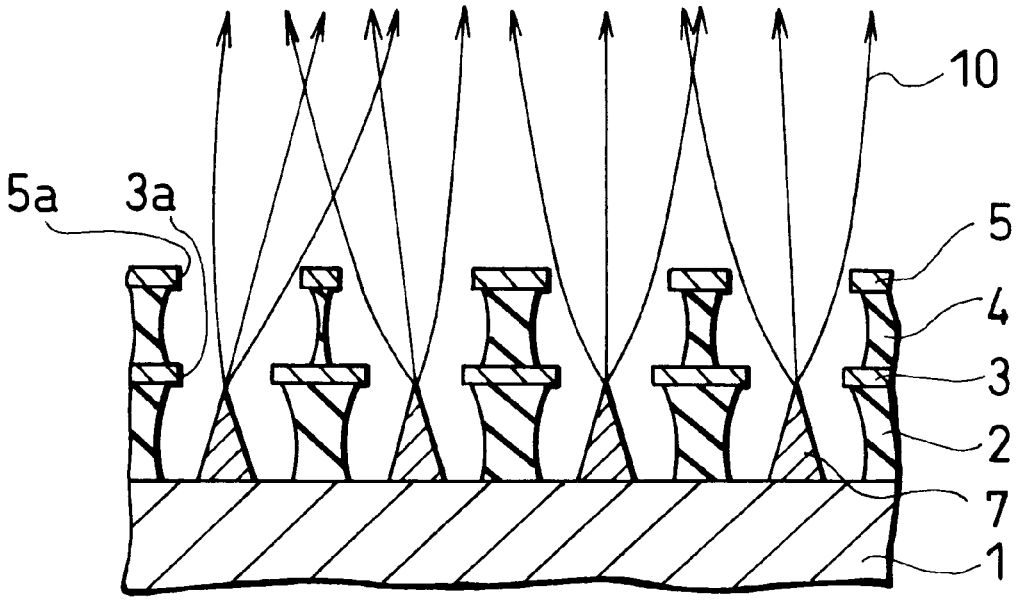
FIG. 16 is a cross-sectional view of a cold cathode substituted for the cold cathode illustrated in FIG. 7.

In a cold cathode illustrated in FIG. 16, central axes of the openings 5*a* of the focusing electrode 5 have no regular positional relation with central axes of the openings 3*a* of the gate electrode 3. That is, the eccentricity between the central axes of the openings 5*a* and the central axes of the openings 3*a* is random with respect to degree and orientation thereof. Similarly to the cold cathode illustrated in FIG. 15, the illustrated cold cathode provides the electron beams 10 made to diverge horizontally in a greater angle. The particles 42 such as those illustrated in FIG. 15 may be stuck to a surface of the emitter 7. As the particles stuck to the emitter 7 break symmetry of an electric field in the vicinity of a summit the emitter 7, the electron beams 10 emitted from the emitter 7 have an increased horizontal velocity component, which is in parallel with the substrate 1.

In the above mentioned embodiments, a central axis of the emitter 7 may be eccentric with a central axis of the gate electrode 3, which provides the same advantageous effects as those of the first embodiment illustrated in FIG. 7.

Hereinbelow is explained a method of fabricating the cold cathode 9 illustrated in FIG. 7 in which a central axis of the emitter 7 is not in alignment with a central axis of the opening 5*a* of the focusing electrode 5. First, the first insulating layer 2, a gate electrode layer, the second insulating layer 4 and a focusing electrode layer are formed on the substrate 1 in this order. Then, a first cavity (not referenced) is formed in the focusing electrode layer and the second insulating layer 3 by means of photolithography and etching. Herein, the first cavity corresponds to the opening 5*a* and the second cavity 4*a* illustrated in FIG. 7.

Then, the focusing electrode layer is covered with and the first cavity is filled with silicon dioxide ($SiO_2$) by means of SOG (spin-on-glass) process, for instance. After a top surface of silicon dioxide has been planarized, photoresist is deposited over a flat surface of silicon dioxide. Then, a second cavity is formed by means of photolithography and etching so that the second cavity passes through silicon dioxide filled in the first cavity, the gate electrode layer and the first insulating layer. Thus, the openings 3*a* as illustrated in FIG. 7 are formed by the second cavity passing through the gate electrode layer. Herein, the second cavity has a central axis which is eccentric with a central axis of the first cavity.

Then, the conically shaped emitter 7 is formed in the second cavity. Specifically, material of which a sacrifice layer is made is obliquely deposited in the second cavity with the substrate 1 being rotated. Then, material of which the emitter 7 is made is vertically deposited in the second cavity. The thus made emitter 7 is coaxial with the opening 3*a* of the gate electrode 3, but is eccentric with the opening 5*a* of the focusing electrode 5.

Finally, silicon dioxide filling the first cavity therewith and silicon dioxide covering the focusing electrode layer therewith is removed. Thus, the cold cathode 9 as illustrated in FIG. 7 is completed.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 8-73693 filed on Mar. 28, 1996 including specification, claims, drawings and summary is incorporated herein by reference in its entirety.

What is claimed is:

1. A cold cathode comprising:

(a) a substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings;

(f) a focusing electrode formed on said second insulating layer and formed with a plurality of second openings which are in communication with said second cavities; and (g) particles randomly formed on a surface of said electrode emitting electrodes, said particles having a radius equal to or greater than a radius of curvature of a summit of said electron emitting electrodes;

at least one of central axes of said second openings and central axes of said first openings being eccentric with central axes of said electron emitting electrodes.

2. The cold cathode as set forth in claim 1, wherein eccentricity between at least one of central axes of said second openings and central axes of said first openings, and central axes of said electron emitting electrodes is random with respect to its degree and orientation.

3. The cold cathode as set forth in claim 1, wherein said electron emitting electrodes have a height above said first openings.

4. The cold cathode as set forth in claim 1, wherein a voltage equal to or higher than a voltage to be applied to said gate electrode is applied to said focusing electrode.

5. The cold cathode as set forth in claim 1, wherein said radius of said particles is in the range of 10 nm to 100 nm.

6. A cold cathode comprising:

(a) a substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings; and (f) a focusing electrode formed on said second insulating layer and formed with a plurality of second openings which are in communication with said second cavities, at least one of central axes of said second openings and central axes of said first openings being eccentric with central axes of said electron emitting electrodes, eccentricity between at least one of central axes of said second openings and central axes of said first openings, and central axes of said electron emitting electrodes being oriented outwardly, and a degree of said eccentricity being set greater at a location more remote from a centrally located electron emitting electrode.

7. The cold cathode as set forth in claim 6, wherein a central axis of an electron emitting electrode disposed at the center of said plurality of electron emitting electrodes, a central axis of an associated second opening, and a central axis of an associated first opening are in alignment with one another.

8. The cold cathode as set forth in claim 6, wherein said electron emitting electrodes have a height above said first openings.

9. The cold cathode as set forth in claim 6, wherein a voltage equal to or higher than a voltage to be applied to said gate electrode is applied to said focusing electrode.

10. The cold cathode as set forth in claim 6 further comprising particles randomly formed on said electron emitting electrodes, said particles having a radius equal to or greater than a radius of curvature of a summit of said electron emitting electrodes.

11. The cold cathode as set forth in claim 10, wherein said radius of said particles is in the range of 10 nm to 100 nm.

12. A light emitting apparatus comprising:

(a) an evacuated enclosure;

(b) a film made of fluorescent material and disposed within said evacuated enclosure;

(c) a transparent anode formed adjacent to said fluorescent material film, to which a voltage is to be applied for accelerating electron beams;

(d) a cold cathode formed on a substrate within said evacuated enclosure in facing relation with said fluorescent material film;

(e) a grid disposed closer to said fluorescent material film than said cold cathode between said fluorescent material film and said cold cathode, said grid extending over the entire length of said fluorescent material film;

(f) a first voltage source for applying a first voltage to said grid; and (g) a second voltage source for applying a second voltage, higher than said first voltage, to said anode, whereby to cause electrons emitted from said cold cathode to diverge horizontally outwardly, the electrons passing through the grid also being further accelerated by an electric field generated between the grid and the transparent anode to bombard the fluorescent material and render the fluorescent material luminous.

13. The light emitting apparatus as set forth in claim 12, wherein said grid includes opposite end portions projecting toward said fluorescent material film relative to other portions.

14. The light emitting apparatus as set forth in claim 12, wherein a voltage to be applied to said grid is equal to or smaller than a half of a voltage to be applied to said anode.

15. The light emitting apparatus as set forth in claim 12, wherein said grid is arcuate in shape.

16. The light emitting apparatus as set forth in claim 15, wherein said grid includes opposite end portions projecting toward said fluorescent material film relative to other portions.

17. The light emitting apparatus as set forth in claim 15, wherein a voltage to be applied to said grid is equal to or smaller than a half of a voltage to be applied to said anode.

18. The light emitting apparatus as set forth in claim 15, wherein said cold cathode comprises:

(a) a substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings;

(f) a focusing electrode formed on said second insulating layer and formed with a plurality of second openings which are in communication with said second cavities; and (g) particles randomly formed on a surface of said electron emitting electrodes, said particles having a radius equal to or greater than a radius of curvature of a summit of said electron emitting electrodes;

at least one of central axes of said second openings and central axes of said first openings being eccentric with central axes of said electron emitting electrodes.

19. The light emitting apparatus as set forth in claim 18, wherein eccentricity between at least one of central axes of said second openings and central axes of said first openings, and central axes of said electron emitting electrodes is random with respect to its degree and orientation.

20. The light emitting apparatus as set forth in claim 15, wherein said cold cathode comprises:

(a) a substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings; and (f) a focusing electrode formed on said second insulating layer and formed with a plurality of second openings which are in communication with said second cavities, at least one of central axes of said second openings and central axes of said first openings being eccentric with central axes of said electron emitting electrodes, eccentricity between at least one of central axes of said second openings and central axes of said first openings, and central axes of said electron emitting electrodes being oriented outwardly, and a degree of said eccentricity being set greater at a location more remote from a centrally located electron emitting electrode.

21. The light emitting apparatus as set forth in claim 20, wherein a central axis of an electron emitting electrode disposed at the center of said plurality of electron emitting electrodes, a central axis of an associated second opening, and a central axis of an associated first opening are in alignment with one another.

22. The light emitting apparatus as set forth in claim 20 further comprising particles randomly formed on said electron emitting electrodes, said particles having a radius equal to or greater than a radius of curvature of a summit of said electron emitting electrodes.

23. A cold cathode comprising:

(a) a substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings; and (f) a ring-shaped focusing electrode disposed around said gate electrode and formed with a plurality of second openings which are in communication with said second cavities, a voltage equal to or higher than a voltage of said gate electrode being applied to said focusing electrode;

at least one of central axes of said second openings and central axes of said first openings being eccentric with central axes of said electron emitting electrodes.

24. A cold cathode comprising:

(a) substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings; and (f) a ring-shaped focusing electrode disposed around said gate electrode and formed with a plurality of second openings which are in communication with said second cavities, a voltage equal to or higher than a voltage of said gate electrode being applied to said focusing electrode;

at least one of central axes of said second openings and central axes of said first openings being eccentric with central axes of said electron emitting electrodes, eccentricity between at least one of central axes of said second openings and central axes of said first openings, and central axes of said electron emitting electrodes being oriented outwardly, and a degree of said eccentricity being set greater at a location more remote from a centrally located electron emitting electrode.

25. A light emitting apparatus comprising:

(a) an evacuated enclosure;

(b) a film made of fluorescent material and disposed within said evacuated enclosure;

(c) an anode formed adjacent to said fluorescent material film, to which a voltage is to be applied for accelerating electron beams;

(d) a cold cathode formed on a substrate within said evacuated enclosure in facing relation with said fluorescent material film, said cold cathode comprising:

(i) a substrate;

(ii) a plurality of electron emitting electrodes formed on said substrate;

(iii) a first insulating layer formed on said substrate and formed with a plurality of first cavities in which said electron emitting electrodes are disposed;

(iv) a gate electrode formed on said first insulating layer and formed with a plurality of first openings which are in communication with said first cavities;

(v) a second insulating layer formed on said gate electrode and formed with a plurality of second cavities which are in communication with said first openings;

(vi) a focusing electrode formed on said second insulating layer and formed with a plurality of second openings which are in communication with said second cavities; and (vii) particles randomly formed on a surface of said electron emitting electrodes, said particles having a radius equal to or greater than a radius of curvature of a summit of said electron emitting electrodes, at least one of central axes of said second openings and central axes of said first openings being eccentric with central axes of said electron emitting electrodes; and (e) means for causing electrons emitted from said cold cathode to have an increased horizontal velocity component in parallel with said substrate.

26. The light emitting apparatus as set forth in claim 25, wherein eccentricity between, at least one of central axes of said second openings and central axes of said first openings, and central axes of said electron emitting electrodes is random with respect to its degree and orientation.

27. A light emitting apparatus comprising:

(a) an evacuated enclosure;

(b) a film made of fluorescent material and disposed within said evacuated enclosure;

(c) an anode formed adjacent to said fluorescent material film, to which a voltage is to be applied for accelerating electron beams;

(d) a cold cathode formed on a substrate within said evacuated enclosure in facing relation with said fluorescent material film, said cold cathode comprising:

(i) a substrate;

(ii) a plurality of electron emitting electrodes formed on said substrate;

(iii) a first insulating layer formed on said substrate and formed with a plurality of first cavities in which said electron emitting electrodes are disposed;

(iv) a gate electrode formed on said first insulating layer and formed with a plurality of first openings which are in communication with said first cavities;

(v) a second insulating layer formed on said gate electrode and formed with a plurality of second cavities which are in communication with said first openings; and (vi) a focusing electrode formed on said second insulating layer and formed with a plurality of second openings which are in communication with said second cavities, at least one of central axes of said second openings and central axes of said first openings being eccentric with central axes of said electron emitting electrodes, eccentricity between at least one of central axes of said second openings and central axes of said first openings, and central axes of said electron emitting electrodes being oriented outwardly, and a degree of said eccentricity being set greater at a location more remote from a centrally located electron emitting electrode; and (e) means for causing electrons emitted from said cold cathode to have an increased horizontal velocity component in parallel with said substrate.

28. The light emitting apparatus as set forth in claim 27, wherein a central axis of an electron emitting electrode disposed at the center of said plurality of electron emitting electrodes, a central axis of an associated second opening, and a central axis of an associated first opening are in alignment with one another.

29. The light emitting apparatus as set forth in claim 28, further comprising particles randomly formed on said electron emitting electrodes, said particles having a radius equal to or greater than a radius of curvature of a summit of said electron emitting electrodes.

30. A cold cathode comprising:

(a) a substrate;

(b) a plurality of electron emitting electrodes formed on said substrate;

(c) a first insulating layer formed on said substrate and formed with a plurality of first cavities in which said electron emitting electrodes are disposed;

(d) a gate electrode formed on said first insulating layer and formed with a plurality of first openings which are in communication with said first cavities;

(e) a second insulating layer formed on said gate electrode and formed with a plurality of second cavities which are in communication with said first openings;

(f) a focusing electrode formed on said second insulating layer and forced with a plurality of second openings which are in communication with said second cavities, at least one of central axes of said second openings and central axes of said first openings being eccentric with central axes of said electron emitting electrodes, eccentricity between at least one of central axes of said second openings and central axes of said first openings, and central axes of said electron emitting electrodes being oriented outwardly, and a degree of said eccentricity being set greater at a location more remote from a centrally located electron emitting electrode; and particles randomly formed on said electron emitting electrodes, said particles having a radius equal to or greater than a radius of curvature of a summit of said electron emitting electrodes.

31. The cold cathode as set forth in claim 30, wherein a central axis of an electron emitting electrode disposed at the center of said plurality of electron emitting electrodes, a central axis of an associated second opening, and a central axis of an associated first opening are in alignment with one another.

32. The cold cathode as set forth in claim 30, wherein said electron emitting electrodes have a height above said first openings.

33. The cold cathode as set forth in claim 30, wherein a voltage equal to or higher than a voltage to be applied to said gate electrode is applied to said focusing electrode.

34. The cold cathode as set forth in claim 30, wherein said radius of said particles is in the range of 10 nm to 100 nm.

35. The cold cathode as set forth in claim 30, wherein said focusing electrode is a ring in shape disposed around said gate electrode, a voltage equal to or higher than a voltage of said gate electrode being applied to said focusing electrode.

36. A light emitting apparatus comprising:

(a) an evacuated enclosure;

(b) a film made of fluorescent material and disposed within said evacuated enclosure;

(c) a transparent anode formed adjacent to said fluorescent material film, to which a voltage is to be applied for accelerating electron beams;

(d) a cold cathode formed on a substrate within said evacuated enclosure in facing relation with said fluorescent material film said cold cathode comprising:

(i) a plurality of electron emitting electrodes formed on said substrate;

(ii) a first insulating layer formed on said substrate and formed with a plurality of first cavities in which said electron emitting electrodes are disposed;

(iii) a gate electrode formed on said first insulating layer and formed with a plurality of first openings which are in communication with said first cavities;

(iv) a second insulating layer formed on said gate electrode and formed with a plurality of second cavities which are in communication with said first openings;

(v) a focusing electrode formed on said second insulating layer and formed with a plurality of second openings which are in communication with said second cavities; and, (vi) particles randomly formed on a surface of said electron emitting electrodes, said particles having a radius equal to or greater than a radius of curvature of a summit of said electron emitting electrodes;

at least one of central axes of said second openings and central axes of said first openings being eccentric with central axes of said electron emitting electrodes; and (e) a grid disposed closer to said fluorescent material film than said cold cathode between said fluorescent material film and said cold cathode, said grid extending over the entire length of said fluorescent material film, a lower voltage than a voltage to be applied to said anode being to be applied to said grid, whereby to cause electrons emitted from said cold cathode diverge horizontally, the electrons passing through the grid also being further accelerated by an electric field generated between the grid and the transparent anode to bombard the fluorescent material and render the fluorescent material luminous.

37. The light emitting apparatus as set forth in claim 36, wherein said grid includes opposite end portions projecting toward said fluorescent material film relative to other portions.

38. The light emitting apparatus as set forth in claim 36, wherein a voltage to be applied to said grid is equal to or smaller than a half of a voltage to be applied to said anode.

39. The light emitting apparatus as set forth in claim 36, wherein said grid is arcuate in shape.

40. The light emitting apparatus as set forth in claim 39, wherein said grid includes opposite end portions projecting toward said fluorescent material film relative to other portions.

41. The light emitting apparatus as set forth in claim 36, wherein a voltage to be applied to said grid is equal to or smaller than a half of a voltage to be applied to said anode.

42. The light emitting apparatus as set forth in claim 30, wherein eccentricity between at least on of central axes of said second openings and central axes of said first openings, and central axes of said electron emitting electrodes is random with respect to its degree and orientation.

43. The light emitting apparatus as set forth in claim 30, further comprising particles randomly formed on said electron emitting electrodes, said particles having a radius equal to or greater than a radius of curvature of a summit of said electron emitting electrodes.

44. A light emitting apparatus comprising:

(a) an evacuated enclosure;

(b) a film made of fluorescent material and disposed within said evacuated enclosure;

(c) an anode formed adjacent to said fluorescent material film, to which a voltage is to be applied for accelerating electron beams;

(d) a cold cathode formed on a substrate within said evacuated enclosure in facing relation with said fluorescent material film, said cold cathode comprising:

(i) a substrate;

(ii) A plurality of electron emitting electrodes formed on said substrate;

(iii) a first insulating layer formed on said substrate and formed with a plurality of first cavities in which said electron emitting electrodes are disposed;

(iv) a gate electrode on said first insulating layer and formed with a plurality of first openings which are in communication with said first cavities;

(v) a second insulating layer formed on said gate electrode and formed with a plurality of second cavities which are in communication with said first openings; and (vi) a focusing electrode formed on said second insulating layer and formed with a plurality of second openings which are in communication with said second cavities, at least one of central axes of said second openings and central axes of said first openings being eccentric with central axes of said electron emitting electrodes, eccentricity between at least one of central axes of said second openings and central axes of said first openings, and central axes of said electron emitting electrodes being oriented outwardly, and a degree of said eccentricity being set greater at a location more remote from a centrally located electron emitting electrode;

(e) means for causing electrons emitted from said cold cathode to have an increased horizontal velocity component in parallel with said substrate, wherein a central axis of an electron emitting electrode disposed at the center of said plurality of electron emitting electrodes, a central axis of an associated second opening, and a central axis of an associated first opening are in alignment with one another; and (f) further comprising particles randomly formed on said electron emitting electrodes, said particles having a radius equal to or greater than a radius of curvature of a summit of said electron emitting electrodes.

* * * * *

UNITED STATES PATENT AND TRADEMARK OFFICE

CERTIFICATE OF CORRECTION

PATENT NO. : 5,965,977
DATED : October 12, 1999
INVENTOR(S) : Makishima

It is certified that error appears in the above-identified patent and that said Letters Patent is hereby corrected as shown below:

Column 19,
Line 57, change "36" to -- 39 --.

Signed and Sealed this

Fourteenth Day of May, 2002

*Attest:*

*Attesting Officer*

JAMES E. ROGAN
*Director of the United States Patent and Trademark Office*